US006857532B2

(12) United States Patent
Przytulla

(10) Patent No.: US 6,857,532 B2
(45) Date of Patent: Feb. 22, 2005

(54) PALLET CONTAINER

(75) Inventor: Dietmar Przytulla, Kerpen (DE)

(73) Assignee: Mauser-Werke GmbH & Co. KG, Brühl (DE)

( * ) Notice: Subject to any disclaimer, the term of this patent is extended or adjusted under 35 U.S.C. 154(b) by 0 days.

(21) Appl. No.: 10/114,594

(22) Filed: Apr. 2, 2002

(65) Prior Publication Data

US 2002/0112980 A1 Aug. 22, 2002

Related U.S. Application Data

(63) Continuation of application No. PCT/EP01/09542, filed on Aug. 18, 2001.
(60) Provisional application No. 60/252,547, filed on Nov. 22, 2000.

(30) Foreign Application Priority Data

Oct. 26, 2000 (DE) ..... 200 18 362

(51) Int. Cl.[7] ..... B65D 19/06
(52) U.S. Cl. ..... 220/1.6; 206/386
(58) Field of Search ..... 220/9.1, 9.4, 495.03, 220/1.6, 1.5, 23.91, 485; 206/386

(56) References Cited

U.S. PATENT DOCUMENTS 5,678,688 A 10/1997 Schutz
2003/0006235 A1 * 1/2003 Przytulla ..... 220/485

FOREIGN PATENT DOCUMENTS

| | | |
|---|---|---|
| DE | 40 16 167 A | 11/1991 |
| DE | 196 42 242 A1 | 3/1998 |
| DE | 297 19 830 U | 5/1998 |
| DE | 200 17 895 U | 1/2001 |
| EP | 0 695 694 B1 | 7/1995 |
| EP | 0 755 863 A1 | 7/1995 |
| EP | 0 734 967 B1 | 3/1996 |

* cited by examiner

*Primary Examiner*—Jim Foster
(74) *Attorney, Agent, or Firm*—Henry M. Feiereisen; Ursula B. Day

(57) ABSTRACT

The invention relates to a pallet container with a thin-walled inner receptacle preferably made from thermoplastic material for the storage and transport of liquid or free-flowing goods, wherein the plastic container is closely surrounded by an outer cage jacket of crossed hollow bars which are configured with dimples by means of which bending points in the cage jacket are established so that when the pallet container is subjected to drops from certain heights, the cage jacket incurs a plastic deformation, thereby preventing fracturing or tearing of the hollow bars from the cage jacket.

17 Claims, 8 Drawing Sheets

PALLET CONTAINER

CROSS-REFERENCES TO RELATED APPLICATIONS

This application is a continuation of prior filed copending PCT International Application No. PCT/EP01/09542, filed Aug. 18, 2001.

This application claims the priority of German Patent Application Serial No. 200 18 362.1, filed Oct. 26, 2000, the subject matter of which is incorporated herein by reference.

This application claims benefit of prior filed provisional application Appl. No. 60/252,547, filed Nov. 22, 2000.

BACKGROUND OF THE INVENTION

The invention relates, in general, to a pallet container and more particularly to a pallet container of a type having a thin-walled inner receptacle, preferably made from thermoplastic material for the storage and transport of liquid or free-flowing goods, wherein the plastic container is closely surrounded by an outer cage jacket as a supporting casing of crossed hollow bars and a bottom pallet on which the thermoplastic receptacle is supported and which is firmly secured to the supporting casing.

Pallet containers of the type that are provided with an upper inlet opening and a discharge valve at the lower portion of the inner plastic receptacle, an outer cage jacket of strong vertical hollows bars or of vertically and horizontally extending hollow bars that are welded together, are generally known in the prior art.

For example, from EP 0 695 694 A (W) a pallet container is known where a cage jacket is made from strong vertical hollow bars that have a round- or oval-shaped cross section. At their upper and lower ends, the vertical bars are bordered by a horizontally surrounding bar and the lower horizontal hollow is fastened to the bottom pallet by means of overlapping clamps.

Another pallet container with a welded cage jacket is known from EP 0734 967 (Sch). There, the hollow bars have a circular profile that is highly compressed at the welded points of intersection. From DE 297 19 830 U1 (VL) a further pallet container is known, which has intersecting bars with a closed profile and a cross section that differs from a circular configuration, but which is especially configured with a uniformly shaped cross sectional profile throughout the entire length of the bar without any cross section reducing dimples or indentations.

A further pallet container with a cage jacket made from square-shaped bars is known from the EP 0 755 863 A (F). In the area of the intersections, the square-shaped hollow bars are only partially indented by about 1 mm so that a four point weld between the straight side walls of the hollow bars facing each other can be realized, and that after welding the flat side walls of the hollow bars are again in contact.

From DE 196 42 242 (R) a pallet container with a welded cage jacket is known where the bars have an open profile, and the outer walls of the profile are provided with straight laterally angled flanged rims that are welded to each other in the area where the bars of the cage jacket intersect.

The cage jackets in the pallet containers of the prior art are attached to the bottom pallet, which may be configured as a flat pallet from plastic or wood or as a steel hollow frame and is usually realized by attachment means such as for example, screws, brackets, clamps or grips that engage the lower horizontally surrounding cage bars. These attachment means are usually either nailed, riveted, screwed or welded to the upper plate or the upper outer edge of the pallet.

For industrial use, the pallet containers have to pass a governmental approval inspection and fulfill certain quality criteria. For example, the filled pallet containers have to undergo interior pressure tests and drop tests from specific heights, which are also conducted at extremely low temperatures. The worst case drop is a diagonal drop onto the lower front wall of the pallet container where the bottom valve from the inner plastic receptacle is located. As has been shown in such drop tests, the inner plastic receptacle tends to become displaced relative to the bottom pallet. Through the kinetic impact energy, especially at the front impact wall and the adjacent lateral surrounding areas, the hollow bars become severely deformed and certain attachment points at the cage jacket become torn from the bottom pallet. The attachment of the lower edge of the cage jacket with the bottom pallet thus poses an essential problem. Since the attachment of the cage jacket is provided only at a few pin-pointed locations, the cage jacket is prone to being unevenly deformed and buckles, whereby the thin-walled plastic receptacle can be damaged by the severed hollow ends or the torn off attachment means.

Pallet containers or combination-IBCs (IBC= Intermediate Bulk Container) of the type discussed here are used for transporting liquids. Preferably, they usually have a filling volume of 1000 liters and consist of a pallet, a stable outer metal bar cage jacket, which is attached to the bottom pallet, and an inner receptacle made from PE-HD, which is firmly surrounded by the cage jacket, and which has an upper inlet opening and a discharge valve in the lower area. When transporting the pallet containers from the manufacturer to the filling station, from the filling station to the customer, from the customer to the reconditioner and so on, the large-volume containers are loaded many times from the truck or a large container to conveyors and are being picked up and set down by fork lifts. Accordingly, it cannot be ruled out that accidents occur where the filled container is accidentally dropped. Likewise, the transport vehicle itself can incur accidents. Also, in drop tests conducted during approval tests, the containers undergo great stress, for example, they are dropped from a height of about 1.9 m onto a steel plate. At such a drop, the load cannot be spilled and the cage jacket has to remain attached to the pallet after impact. This also applies to "flexible IBCs", those with a flexible inner receptacle (i.e. a cloth sack) used for granulate loads.

As a starting point for the latest trends in the present invention, extensive serial tests were conducted with five pallet containers of the above-described different types currently available on the market. These pallet containers showed some serious deficiencies, in particular as a result of the drop tests.

SUMMARY OF THE INVENTION

According to one aspect of the present invention, an improved pallet container is provided which is designed to obviate the afore-stated shortcomings and drawbacks and which is configured such that an improved drop impact stability is realized and which has an improved resistance against deformation of the cage jacket through simple constructive means, so that a higher drop impact resistance, defined as a one-time overload, is realized.

Another aspect of the present invention is to provide a pallet container suitable for transporting dangerous liquids or free-flowing loading goods up to the highest standard of approval quality.

Another aspect of the invention is to provide a pallet container wherein the most sensitive spot at the container, the area of the lower discharge valve, is better protected, and that the pallet container that has been dropped and is thus deformed, remains absolutely liquid proof and can be lifted and handled by means of a fork lift without any problems. In addition, the pallet container should be suitable for passing the highest approval tests for dangerous liquids or free-flowing goods.

These aspects, and others which will become apparent hereinafter, are attained in accordance with the present invention wherein the pallet container is provided comprising a bottom pallet a thin-walled inner thermoplastic receptacle for storage and transport of liquid or free-flowing contents; and a cage jacket closely surrounding the receptacle and securely connected with the bottom pallet, wherein the cage jacket includes vertical and horizontal hollow bars welded together at points of intersection wherein the hollow bars are configured with means to effect a plastic deformation at specific predetermined points in the cage jacket when the cage jacket is subjected to impact stress from a drop, without fracturing or tearing any of the hollow bars.

As an example, the means for establishing a plastic deformation can be provided in the vertical bars only for a container drop at the front edge of the pallet where the discharge valve is located, In one embodiment of the invention, the plastic deformation of the cage jacket is realized by providing a bending point in the cage jacket by reducing the size of the cross section of the hollow bar. The size reduction of the cross section of the hollow bar at the bending point can be realized by asymmetrically dimpling the hollow bar on one side. In a preferred embodiment, the reduction of the hollow bar cross section at the bending point is realized through symmetrical dimpling of the bar such as on two sides that are opposite each other.

In accordance with the invention, establishing the bending points in the vertical hollow bars for the protection of the lower discharge valve is realized by providing dimples in the vertical bars at the two longer side walls formed in a direction parallel to the side walls, while the dimples for creating the bending points in the vertical bars at the shorter front wall (at the discharge valve) and rear wall extend in a direction vertical to the front/rear wall.

In a preferred embodiment, the pattern for plastic deformation in a container drop is realized when the dimples for producing the bending points are provided directly above or below the intersection of a horizontally extending hollow bar.

In another preferred embodiment, the dimples, which are provided to produce the bending points, are configured with varying depths. The dimples are configured in such a fashion, that they have the greatest depth in the horizontal bars that are above the lowest of the horizontal surrounding hollow bars, which is attached to the bottom pallet, and their depth decreases stepwise in the horizontal and surrounding hollow bars (when seen from below) that are further up.

In a simpler embodiment, the dimples are provided only at a close range of the points of intersection in the three lowest horizontally surrounding hollow bars.

It is a special feature of the invention, that the hollow bar profile is dimpled not directly at the welding point. The bar profile is partially dimpled in the area next to the welding points, that is, at a distance from the welding points, wherein the dimples in the hollow bars along the long walls of the container extend parallel, and those at the shorter side walls of the container (with the discharge valve) are partially dimpled perpendicular thereto, whereby, relative to the welding points, a reduced bending section modulus is realized that serves to reduce stress at the welding connections at the intersections of the hollow bars when they are exposed to sudden stress.

The length of the dimples for producing the bending points is in the range between 15 mm and 45 mm, preferably about 30 mm, wherein the depth of the dimples at the bending points should be between 15% to 50%, preferably about 33% of the hollow bar cross section. While this causes only a very measured reduction of the flexural strength in the dimpled hollow bars, the susceptibility of the hollow bars to crack formation is considerably reduced.

BRIEF DESCRIPTION OF THE DRAWINGS

The invention is explained and described in greater detail hereinafter with reference to embodiments, which are illustrated in the drawings. It is shown in.

DETAILED DESCRIPTION OF PREFERRED EMBODIMENTS

Figure 1:
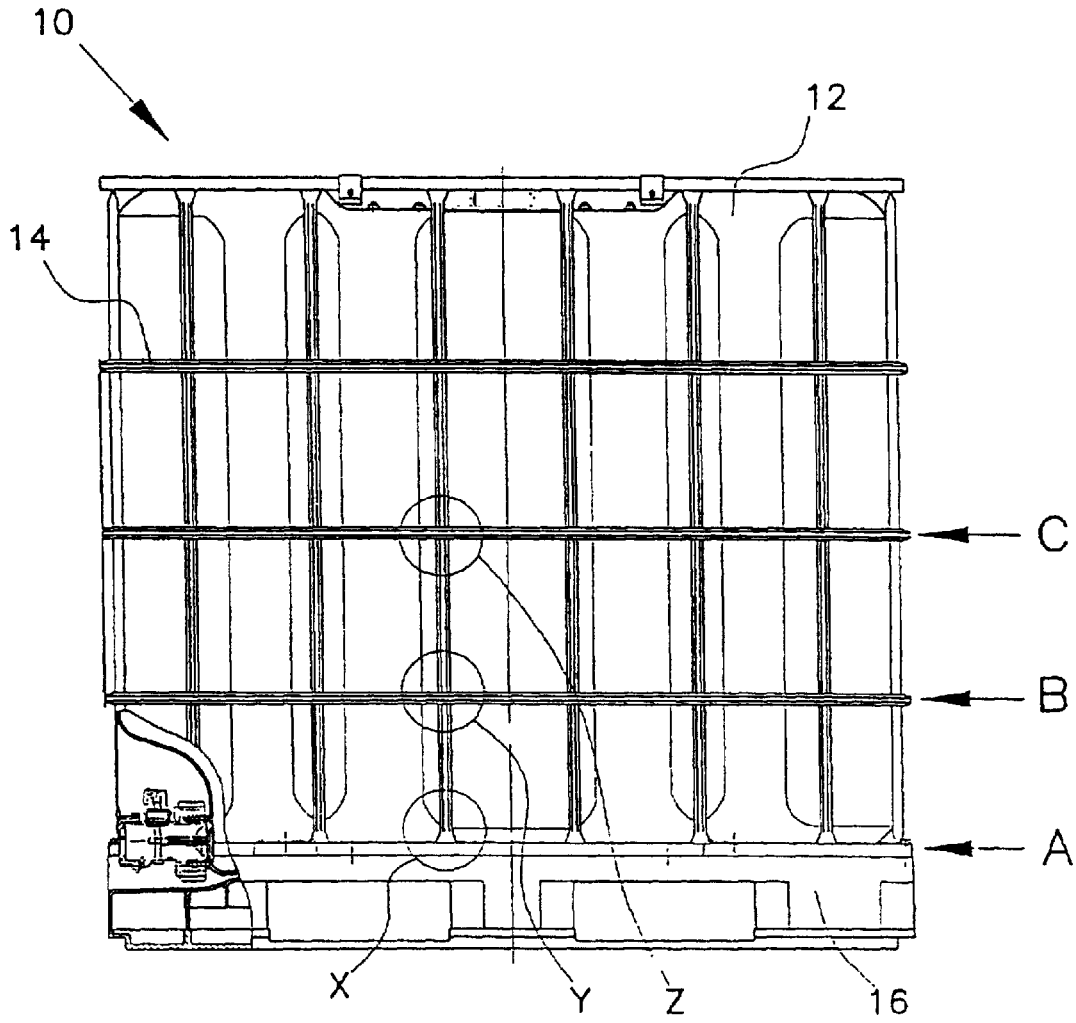
FIG. 1 a side view of a pallet container according to the invention.

Shown in FIG. 1 and referenced as numeral 10 is a pallet container according to the invention, which shows a thin-walled blow-molded inner receptacle 12 made of thermoplastic material (HD-PE) with an upper inlet opening and a cage of intersected hollow bars 14 tightly enveloping the inner receptacle, and which is firmly—but detachably or interchangeably—connected with the bottom pallet 16. The dimensions of the bottom pallet 16, or respectively the pallet container 10 are 1000 mm×1200 mm. The side view as illustrated shows the longer side of the pallet container 10 with the discharge valve near the bottom in the plastic container 12. The left lower front edge of the bottom pallet 16 with the discharge valve situated above, represents the most sensitive point on the pallet container, and is being submitted to the greatest stress during the approval test, in particular during the diagonal drop test. In the circles as shown, the three hollow bar intersections are indicated with X, Y and Z, wherein the intersection referenced as Z is disposed at the level A of the lowest horizontal bar, the intersection Y at the level B of the second horizontal lower bar and the intersection Z at the level C of the third horizontal bar seen from below. These intersections are further discussed in detail.

Figure 2:
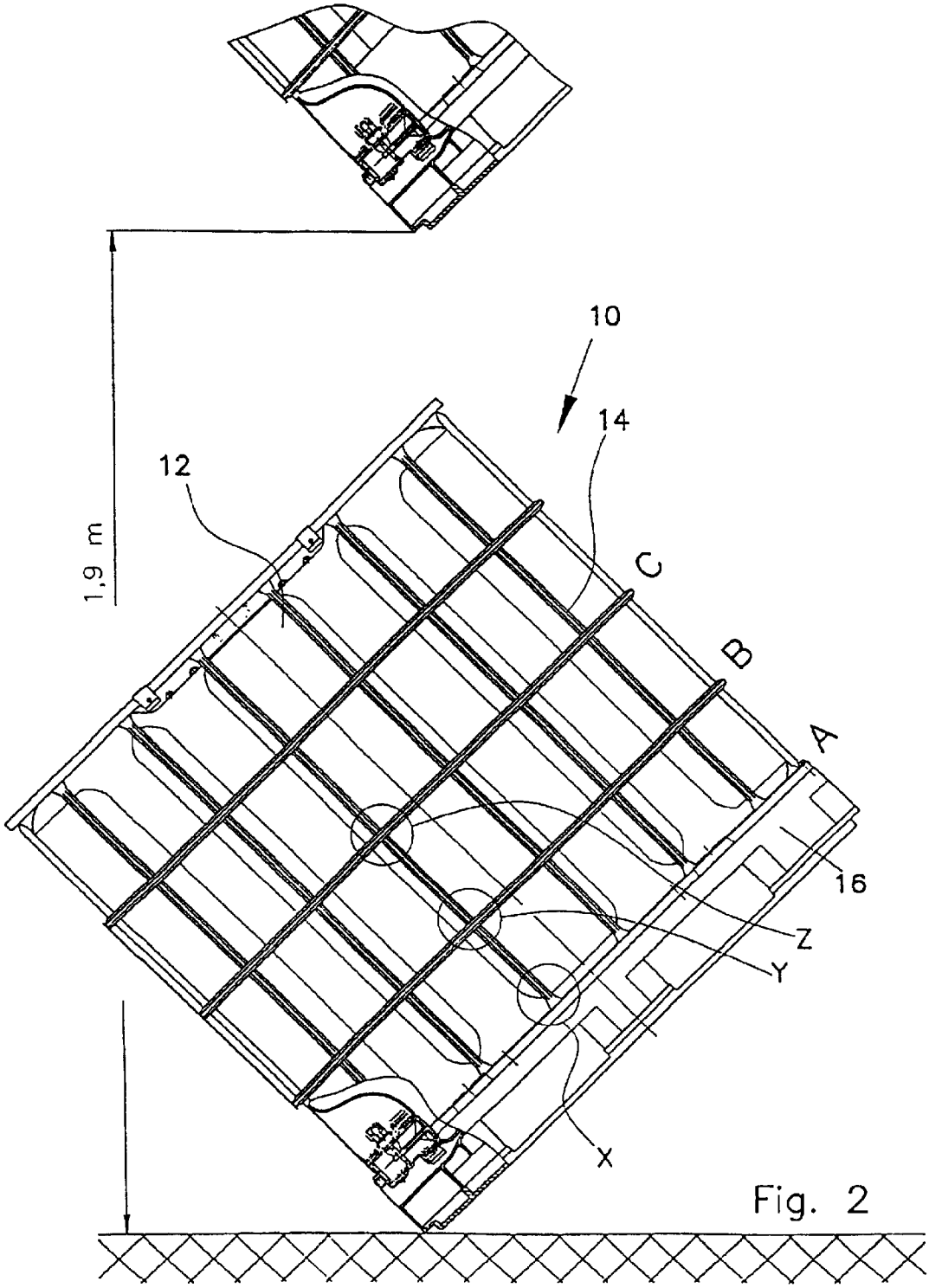
FIG. 2 the pallet container according to FIG. 1 shown during a drop test.

The testing pallet container 10 depicted in FIG. 2 is submitted for testing purposes to a diagonal drop test; where the areas also marked as circles X, Y and Z in the vertical and horizontal hollow bars are shown for illustration purposes only (as a detail) and which, according to the drop-test results, are submitted to great stresses, resulting in crack formation and at various points breakage of the bars occurs. Of course, a deformation occurs more or less in the entire region of the lower cage jacket.

Figure 3:
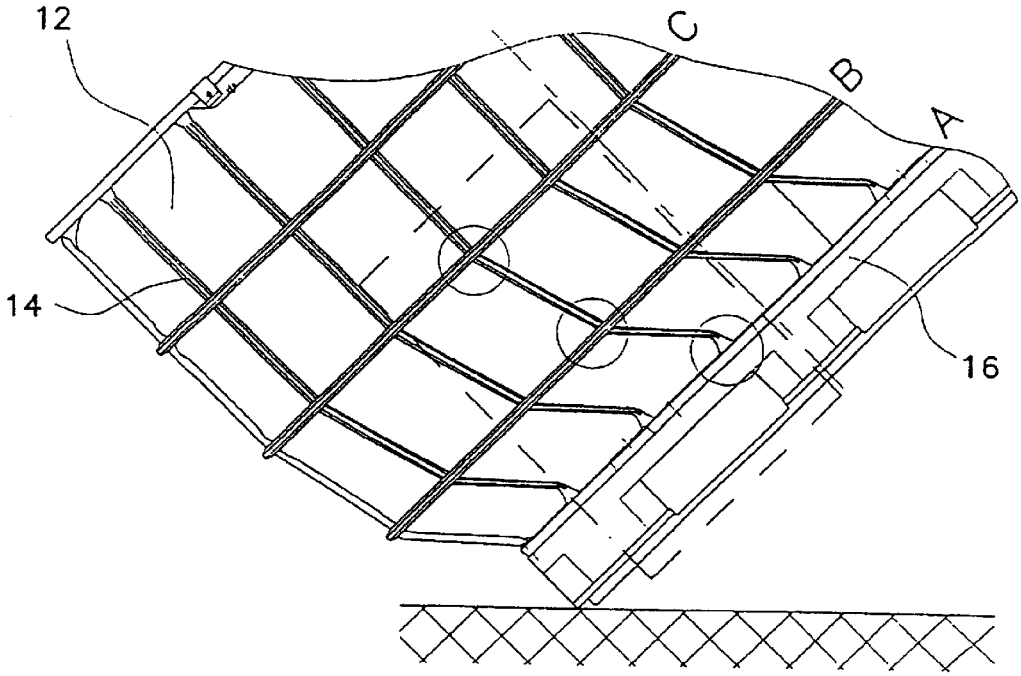
FIG. 3 the pallet container according to FIG. 1 at the moment of impact on the floor.
Figure 4:
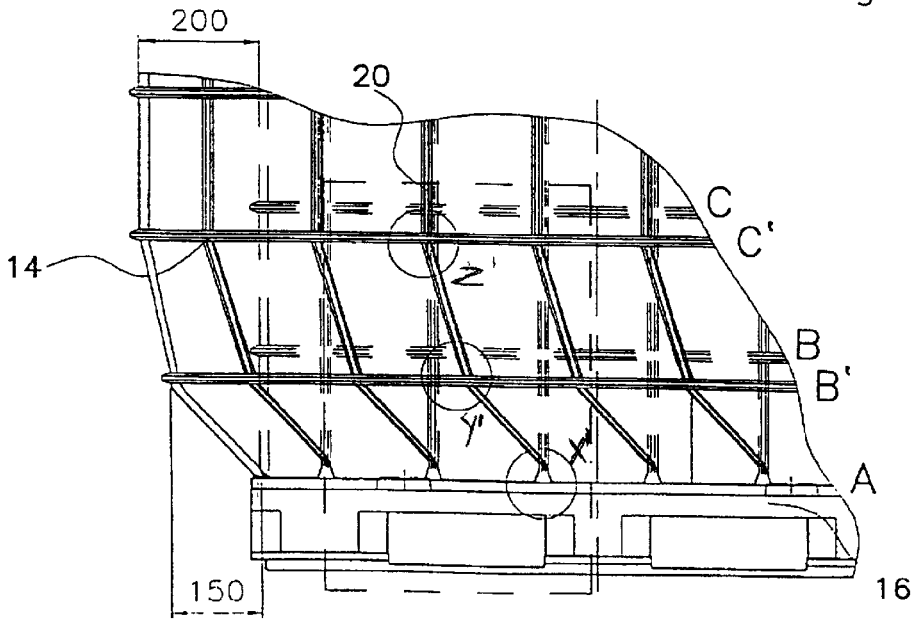
FIG. 4 the pallet container according to FIG. 3 after floor impact.

FIG. 3 shows the test-pallett container 10 according to FIG. 2 at the moment of impact on the floor. Through the kinetic energy of the liquid load, considerable elastic and plastic deformations are caused in the construction parts comprising the inner receptacle 12, the cage jacket 14 and the bottom pallet 16. FIG. 4 shows the test-pallet container 10 with permanent deformations after the drop test (according, to FIG. 3). In particular, the vertical bars 20 are severely bent or have buckled. At the second lowest cage jacket level B, the cage jacket 14 has been already displaced by about 150 mm—and in total (above) by about 200 mm, relative to the drop impact edge of the bottom pallet 16.

Figure 5:
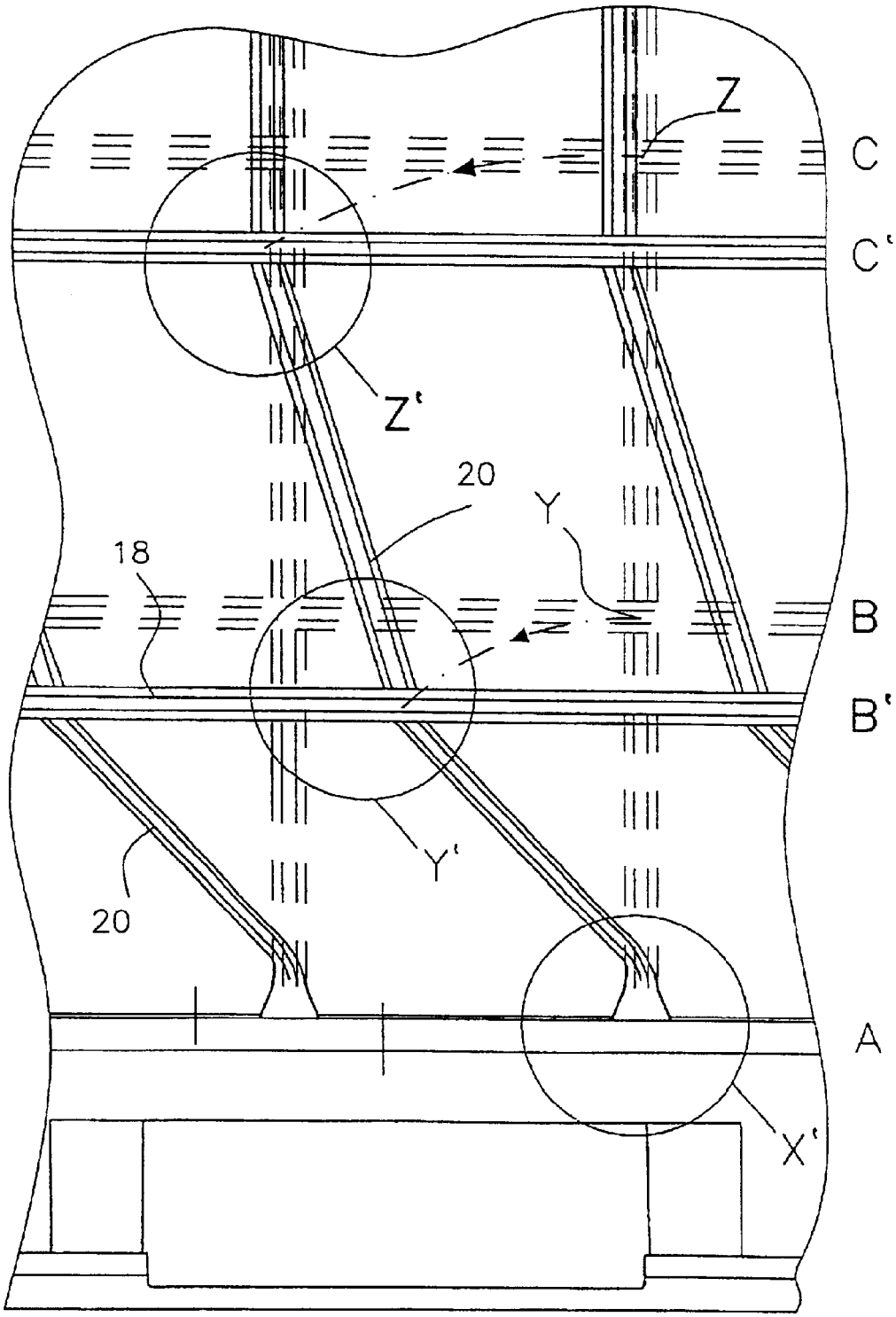
FIG. 5 a detailed view on an enlarged scale of the cage jacket side showing points of intersections Z and Y and displaced points Z', Y' and X' shown in circles.
Figure 6:
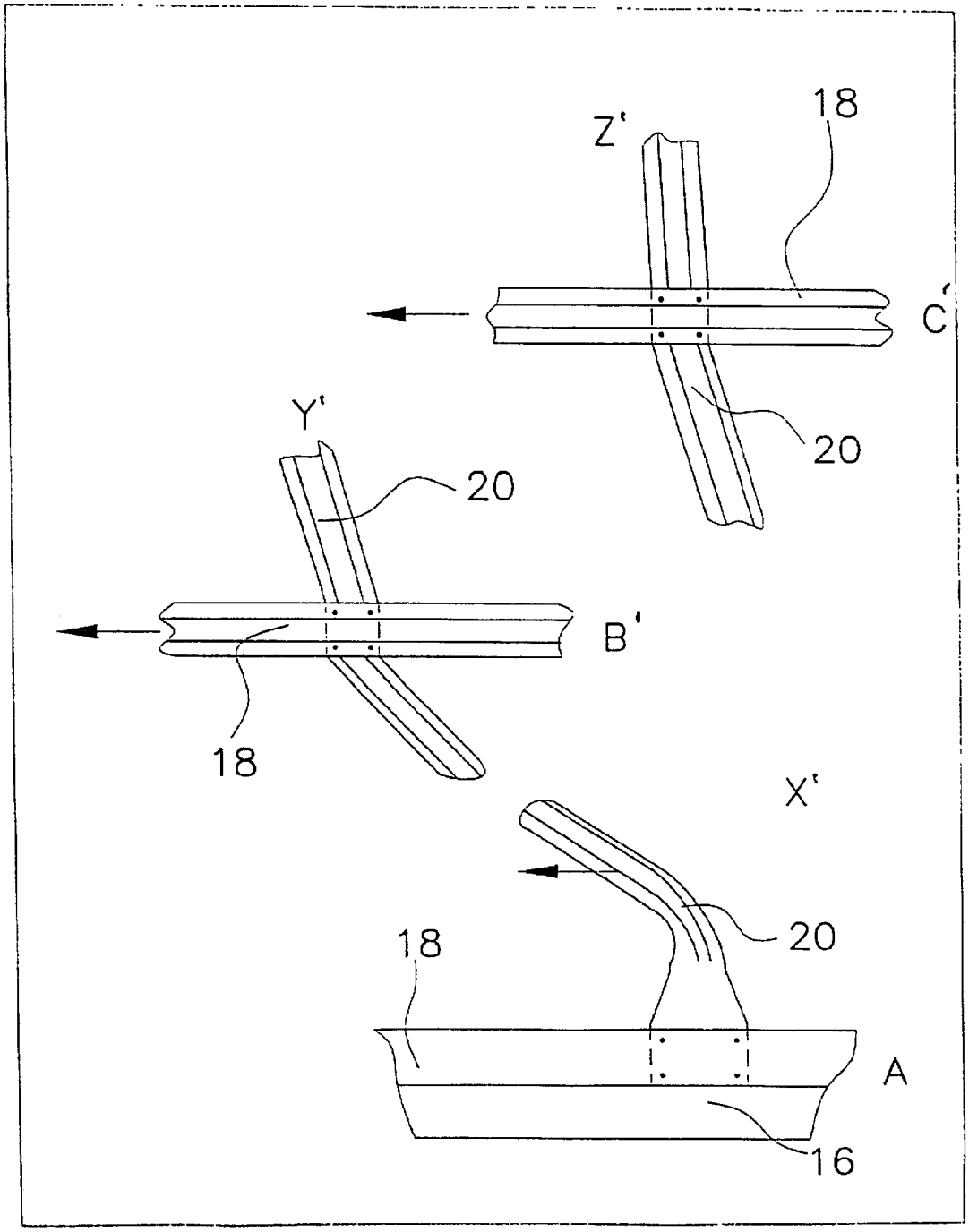
FIG. 6 a schematic illustration of portions of the deformed cage jacket.

FIG. 5 illustrates, that the marked intersections Y and Z (as well as also each of the neighboring ones) were laterally displaced downwardly according to a parallelogram-kinematics as indicated by Z', Y' and X'; whereby the horizontal hollow bars 18 show virtually no plastic deformation but the vertical hollow bars 20 exhibit a very severe plastic deformation. In FIG. 6, this severe deformation in the area of the marked intersections X', Y' and Z' is once more schematically emphasized. There, it is seen, that a vertical hollow bar 20 above an intersection always buckles at one side (in FIG. 6 towards the left side) and below the intersection, always at the other side (in FIG. 6 towards the right side). The buckling and shear tension forces that occur are minimal at the intersection Z; they are higher at the intersection Y and are highest at the intersection X in the lowest cage jacket level A. The attachment of the lowest horizontal hollow bar 18 with the pallet 16 causes additional shear stresses that must be absorbed in this area (intersection X).

The intersection X is a particularly weak area in the afore-described drop-test and the vertical hollow bar oftentimes tears, or at higher drop heights, is torn off entirely. The crack formation always begins from the side with the highest pull tension.

A sharp-edged crack area at the lower hollow bars can also lead to damage of the inner receptacle thereby causing leakage of the filling goods from the receptacle. Another weak area may exist in the region Y. There, the inner receptacle can get jammed and also damaged when the horizontal bar B and the vertical bar are being displaced by the 45° drop.

Prior to developing the pallet container according to the invention, five different pallet containers which are for sale on the market, of the type as afore-described were submitted to precise comparative stress tests, namely inner pressure tests, drop tests, vibration tests, pressure tests required for upsetting respectively for stacking. In conducting these serial drop tests, particularly frequently occurring weak areas in each of the cage jacket regions have materialized. The extreme deformations at the vertical bars always appeared directly at the welding points. In the field, it has been shown that the welding points regularly survive the rigorous stresses of the drop tests, however, due to the material brittleness and the additional shear stresses at the bending points—directly next to the welding points—the vertical bars frequently crack or tear off.

Figure 7:
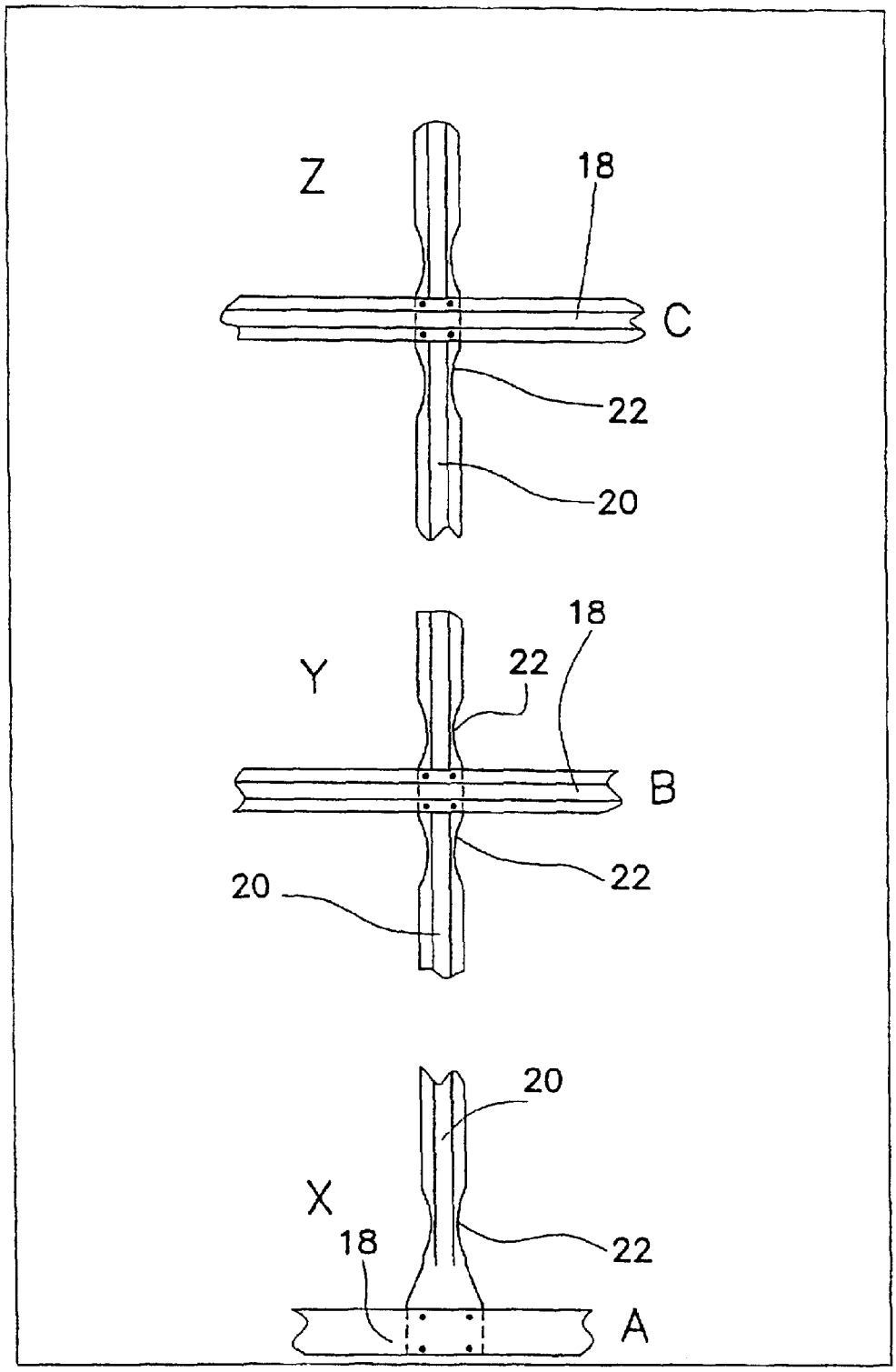
FIG. 7 a schematic illustration of the configuration of a cage jacket according to the invention.

FIG. 7 is a schematic representation of the means for improving the deformation pattern in a dropped pallet container according to the invention.

The vertical profiled bar 20 is provided with dimples 22 near the welding points at the intersections, whereby always at least one dimple 22 is provided between two intersections. The vertical bar profile 20 is thereby reduced in its width, which means it is indented or, respectively constricted (at the level of cage jacket deformation in the drop test).

By dimpling the vertical bars next to the welding points at a selected area and at a certain distance from the welding point, a predetermined weak point is being introduced, designed to absorb the occurring bending stresses and thus relieving the welding areas from the bending tensions. At a small distance from the welding points, the hollow profile is indented so that about 3 mm to 5 mm remain un-indented, such that the bending will occur in an area, which is not embrittled from the welding operation. By configuring the vertical bars according to the invention with the afore-described dimples so that a reduction in the cross section of the bar is effected, the afore-described shortcomings of the prior art are appreciably reduced; that is, they occur only under considerably higher stress loads, respectively at elevated dropping heights.

The depth of the dimples designed to form the wanted bending points can be maximally about 50% of the bar profile. The total depth of the dimple even with two-sided dimpling should be about in the range of 15% to 50% of the width of the hollow bar profile, preferably about a third (33%). While this dimpling reduces the flexural strength of the hollow profile by a very reasonable amount, the susceptibility to crack formation or the possibility that a bar is perhaps completely torn off is considerably lowered.

At the side of the welding points, the dimples are configured comparatively deep and becoming gradually flatter towards the other side. A dimple of about 15 mm (=about 33%) is normally sufficient in a profile with a height, respectively a width of 15 mm, so that the maximum of flexural stress is kept away from the welding point, but the bar retains a sufficiently high stiffness. This is important in order to keep a sideways shifting of the cage jacket, for example by interior pressure admission, as low as possible.

Figure 8:
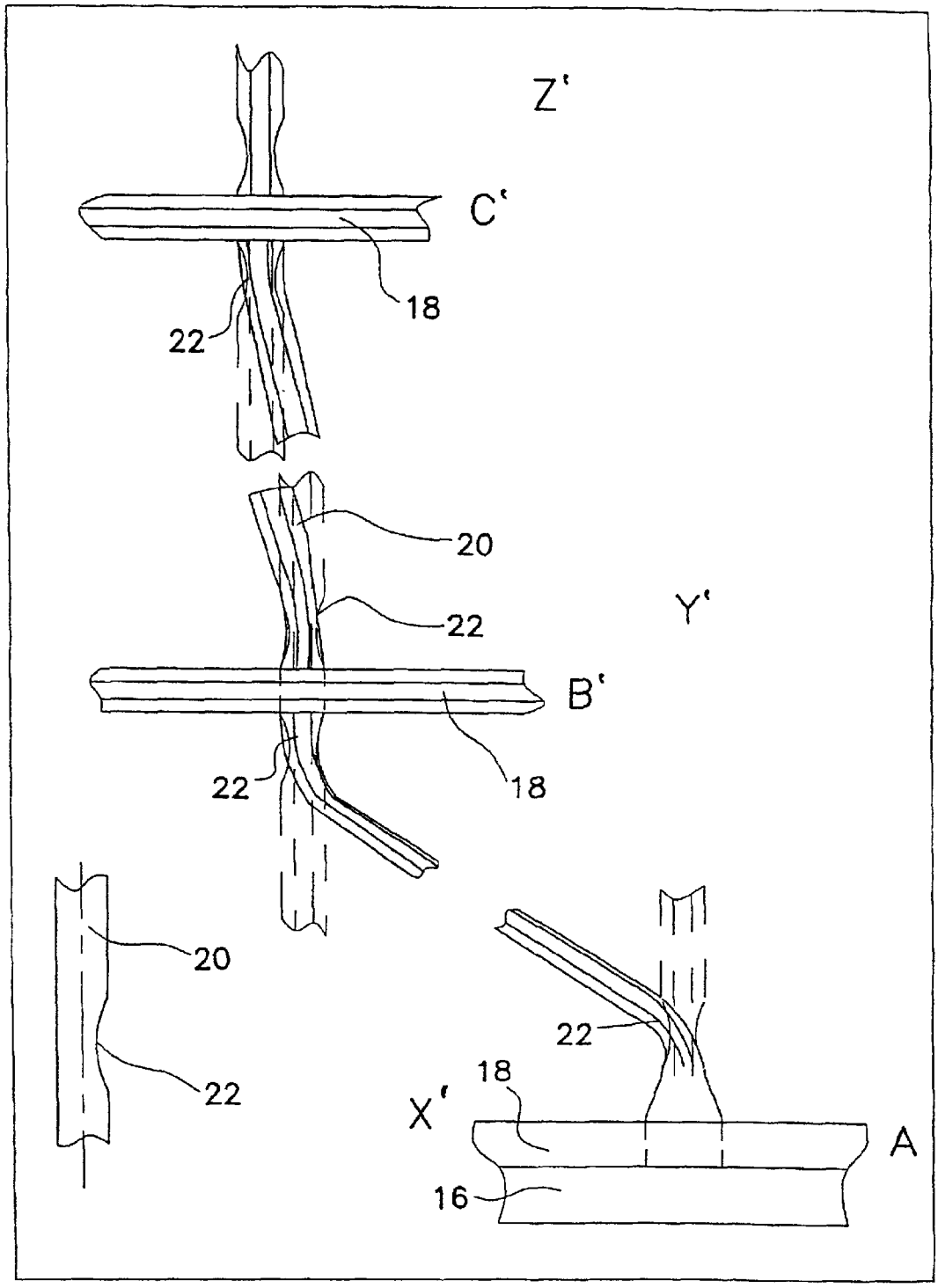
FIG. 8 a schematic illustration of parts of the cage jacket according to FIG. 7 after the drop test of the pallet container.

FIG. 8 is a schematic representation of the condition of intersections A, B' and C' according to FIG. 7 after conducting the drop test of the pallet container according to the invention. Bending of the vertical hollow bars 20 as seen here has occurred in the area of the dimples 22. By means of the reduced flexural strength in the dimples 22, the deformation of the endangered intersections, respectively the welding points shifted away towards the wanted bending point, so that no crack formation occurs directly at the welding point.

As schematically depicted at the vertical hollow bar 20 (bottom left of FIG. 8), a dimple 22 may be formed only at one side of the bar. In a preferred embodiment, a wanted bending point is realized through symmetrical two-sided dimples 22 (cross section reduction).

Figure 9:
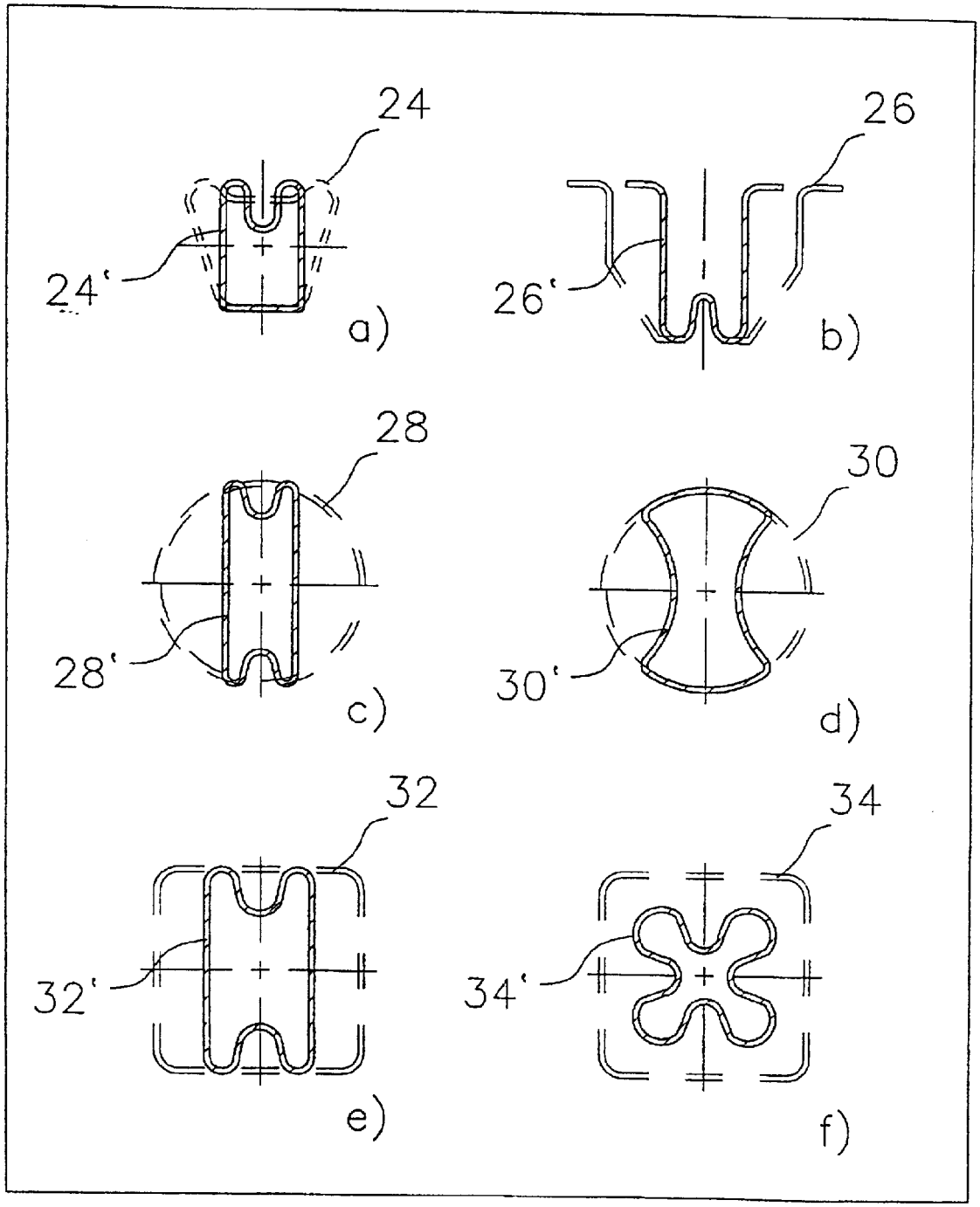
FIGS. 9*a*) through 9*f*) various hollow profiles in unshaped and shaped configuration.

FIG. 9 shows six examples of different hollow bar profiles schematically represented with their respective dimples. The technical teaching in accordance with the invention is thus not limited to a specific hollow bar profile.

In these exemplary partial illustrations, the undimpled "normal" hollow bar profile is drawn each—in broken lines—and the areas of the dimples according to the invention are drawn in continuous lines.

FIG. 9*a* shows a preferred closed trapezoidal-shaped hollow bar profile 24 (M) (height/width=18/15 mm), which has high performance values in each of the conducted approvals. A possible embodiment of the sideways dimpling is referenced as 24'.

FIG. 9*b* shows a known open partial-trapezoidal-shaped bar profile 26 (R) with a possible dimple 26' according to the invention.

FIG. 9*c* shows a known round hollow bar profile 28 (S) (diameter 18 mm) showing a possible dimple 28' according to the invention, where the cross section reduction was carried out at each side and additionally carried out from the top and bottom.

FIG. 9*d* shows another known round hollow bar profile 30 (VL) (diameter 20 mm) with a dimple 30', wherein the cross section reduction is effected only by means of the indented sides.

FIG. 9*e* shows a square-shaped hollow bar profile 32 (F) (height/width 18 mm) with a possible cross section reduction 32' effected by means of indentations on all four sides.

FIG. 9*f* shows a square-shaped hollow bar profile 34 and another possible dimple 34' wherein the configuration is symmetrical in the form like a four-leafed clover.

The invention can of course also be realized for the flexible IBCs with a metal bar cage jacket, for example with an inner receptacle from cloth for use with granulated goods.

While the invention has been illustrated and described as embodied in a pallet container, it is not intended to be limited to the details shown since various modifications and structural changes may be made without departing in any way from the spirit of the present invention.

What is claimed as new and desired to be protected by Letters Patent is set forth in the appended claims:

1. A pallet container comprising:

a bottom pallet;

a thin-walled inner receptacle for storage and transport of liquid or free-flowing contents; and a cage jacket closely surrounding the receptacle and securely connected with the bottom pallet, wherein the cage jacket includes vertical and horizontal hollow bars, wherein at least a number of the hollow bars have a protective means to effect a plastic deformation of the cage jacket at predetermined locations, when the cage jacket is subjected to impact stress from a drop, without encountering a fracture or tear to any of the hollow bars, wherein the protective means is provided only in vertical ones of said number of hollow bars.

2. The pallet container of claim 1, wherein the receptacle is made of thermoplastic material.

3. The pallet container of claim 1, wherein the protective means is constituted by a reduction in cross section of each said vertical hollow bar to define a bending point.

4. The pallet container of claim 3, wherein the reduction in cross section of each said vertical hollow bar at the bending point is realized by providing a dimple in said hollow bar at least on one side thereof.

5. The pallet container of claim 3, wherein the reduction in cross section of each said hollow bar at the bending point is realized by providing a dimple in said hollow bar on one side thereof and a dimple in said hollow bar on an opposite side thereof.

6. The pallet container of claim 1, having a configuration with opposite long sides and opposite short sides, wherein each said vertical ones of the hollow bars in the long sides has the protective means.

7. The pallet container of claim 1, having a configuration with opposite long sides and opposite short sides, wherein each said vertical ones of the hollow bars in the short sides has the protective means.

8. The pallet container of claim 4, wherein the dimple for providing the bending point at said vertical hollow bars is disposed at a location between two points of intersection with the horizontal hollow bars.

9. The pallet container of claim 4, wherein the dimple for providing the bending point at said vertical hollow bars is disposed at a location directly above or below a point of intersection with a horizontal one of the hollow bars.

10. The pallet container of claim 1, wherein the protective means are dimples formed in the hollow bars, said dimples having varying depth.

11. The pallet container of claim 10, wherein the dimples have successively decreasing depth, with the depth of dimples disposed above a lowermost one of the horizontal hollow bars, which is secured to the bottom pallet, having a greatest depth and with the depth of dimples being positioned thereabove decreasing in the order of increasing distance from the lowermost one of the horizontal hollow bars.

12. The pallet container of claim 1, wherein the protective means is provided only in vertical ones of said number of hollow bars in proximity of three lowermost of the horizontal hollow bars.

13. The pallet container of claim 4, wherein the dimple has a length between 15 mm and 45 mm.

14. The pallet container of claim 13, wherein the dimple has a length of about 30 mm.

15. The pallet container of claim 4, wherein the dimple has a depth between 15% to 50% of a cross section of the hollow bars.

16. The pallet container of claim 15, wherein the depth of the dimple is 33% of the hollow bar cross section.

17. The pallet container of claim 13, wherein the dimple has a length of about 30 mm.

* * * * *